US011653421B2

(12) United States Patent
Kim

(10) Patent No.: US 11,653,421 B2
(45) Date of Patent: May 16, 2023

(54) ELECTRIC HEATING APPARATUS WITH MULTIPLE HEATING LAMPS

(71) Applicant: JK Lighting Co., Ltd, Yongin-si (KR)

(72) Inventor: Hak Sil Kim, Yongin-si (KR)

(73) Assignee: JK Lighting Co., Ltd, Yongin-si (KR)

( * ) Notice: Subject to any disclaimer, the term of this patent is extended or adjusted under 35 U.S.C. 154(b) by 329 days.

(21) Appl. No.: 17/094,576

(22) Filed: Nov. 10, 2020

(65) Prior Publication Data

US 2021/0160967 A1 May 27, 2021

(30) Foreign Application Priority Data

Nov. 22, 2019 (KR) ..... 10-2019-0151041

(51) Int. Cl.
*H05B 3/00* (2006.01)
*F24D 13/00* (2006.01)
(Continued)

(52) U.S. Cl.
CPC ..... *H05B 3/009* (2013.01); *F21V 7/0008* (2013.01); *F21V 19/02* (2013.01); *F24D 13/00* (2013.01);
(Continued)

(58) Field of Classification Search
None
See application file for complete search history.

(56) References Cited

U.S. PATENT DOCUMENTS 1,267,882 A * 5/1918 McFaddin ..... A61N 5/06 362/399
1,309,051 A * 7/1919 Willman ..... F21V 19/02 439/527
(Continued)

FOREIGN PATENT DOCUMENTS

CN 207184837 U 4/2018
JP 2006-185768 A 7/2006
(Continued)

OTHER PUBLICATIONS

Office Action of Corresponding CA patent application No. 3,099,379 (dated Feb. 9, 2022).
(Continued)

*Primary Examiner* — Thor S Campbell
(74) *Attorney, Agent, or Firm* — Knobbe, Martens, Olson & Bear, LLP

(57) ABSTRACT

The described technology provides an electric heating apparatus with multiple heating lamps that can increase the heat emitted by a single heating apparatus, thereby allowing a minimal number of heating apparatus installations in the space where heating is needed, and can prevent fires by turning the power off immediately in the event of the heating apparatus falling off. According to the described technology, multiple heating lamps may be positioned within the reflector dish, and the heating lamps may have particular inclinations to allow a broader range of irradiation and increase efficiency in terms of installing, maintaining, and operating the electric heating apparatus; the heat of the reflector dish and the heating lamps themselves may be discharged by way of conduction at the upper portion of the reflector dish.

5 Claims, 7 Drawing Sheets

(51) Int. Cl.
*F24H 3/06* (2022.01)
*F21V 7/00* (2006.01)
*F21V 19/02* (2006.01)

(52) U.S. Cl.
CPC ..... *F24H 3/062* (2013.01); *H05B 2203/032* (2013.01)

(56) References Cited

U.S. PATENT DOCUMENTS 1,479,069 A * 1/1924 Hance ..... F21V 19/02 362/429
1,880,952 A * 10/1932 Fabrey ..... F21V 19/02 439/529
1,972,056 A * 8/1934 Saaf ..... F21V 19/02 362/429
2,222,319 A * 11/1940 Gray ..... F21V 7/04 362/245
2,603,738 A * 7/1952 Schubert, Jr. ..... A61N 5/06 119/309
2,856,898 A * 10/1958 Doubleday ..... A01K 39/0113 119/57.9
3,225,154 A * 12/1965 Henne ..... F21V 21/104 200/51.09
3,735,329 A * 5/1973 Funabashi ..... F21V 21/108 362/411
4,232,361 A * 11/1980 Kelsall ..... F21S 8/026 362/404
4,704,664 A * 11/1987 McNair ..... F21S 8/04 362/345
4,888,468 A * 12/1989 Maendel ..... A01K 1/0076 119/309
4,922,393 A * 5/1990 McNair ..... F21S 8/02 362/225
5,197,798 A * 3/1993 Tickner ..... F21V 23/00 362/221
5,528,473 A * 6/1996 Kassay ..... F21S 8/04 362/453
RE36,414 E * 11/1999 Tickner ..... F21V 7/28 362/225
6,024,468 A * 2/2000 Kassay ..... F21V 23/02 362/217.05
6,234,653 B1 * 5/2001 Karton ..... H05B 3/0033 362/438
RE37,310 E * 8/2001 Shemitz ..... F21V 7/005 362/225
6,408,789 B1 * 6/2002 Hsiao ..... A01K 39/0113 119/57.9
6,764,204 B1 * 7/2004 Peters ..... A01K 31/19 362/407
7,153,003 B2 * 12/2006 Nakamura ..... H01R 33/0818 362/240
7,171,921 B1 * 2/2007 Lush ..... A01K 39/0113 119/57.9
7,264,379 B2 * 9/2007 Ruben ..... F21V 29/503 362/373
7,484,861 B2 * 2/2009 Wu ..... H01J 61/327 362/294
7,513,646 B2 * 4/2009 Catone ..... F21V 7/05 362/405
7,524,083 B2 * 4/2009 Sandoval ..... F21V 15/01 362/147
7,757,369 B2 * 7/2010 Kassay ..... F21V 29/83 362/404
7,972,043 B2 * 7/2011 Schutte ..... F21V 17/164 362/147
8,657,474 B2 * 2/2014 Breen, IV ..... H01R 13/514 362/365
8,814,395 B1 * 8/2014 Schmitt ..... F21V 21/002 362/650
10,113,722 B2 * 10/2018 Al-Khulaifi ..... F21V 23/06
2001/0019661 A1 9/2001 Choi
2003/0075112 A1 * 4/2003 Lush ..... A01K 39/0113 119/57.9
2005/0057927 A1 3/2005 Nakamura
2011/0121726 A1 * 5/2011 Erchak ..... F21K 9/238 315/32
2013/0175915 A1 7/2013 Yang
2013/0176726 A1 7/2013 Yang
2014/0063806 A1 * 3/2014 Huang ..... F21V 29/507 362/249.02
2017/0223775 A1 * 8/2017 Scanlon ..... H05B 3/06
2018/0288847 A1 * 10/2018 Halliwell ..... H05B 45/10
2021/0160967 A1 * 5/2021 Kim ..... F24D 13/00

FOREIGN PATENT DOCUMENTS

JP 4151788 B2 9/2008
KR 10-0905702 B1 7/2009
KR 10-2013-0081669 A 7/2013
KR 10-1428785 B1 8/2014
KR 10-1959713 B1 3/2019
WO 2016/209065 A2 12/2016

OTHER PUBLICATIONS

Office Action of Corresponding CN patent application No. 201911289332.5 (dated Sep. 23, 2022).
Office Action of Corresponding KR patent application No. 10-2019-0151041 (dated Sep. 24, 2020).

* cited by examiner

ELECTRIC HEATING APPARATUS WITH MULTIPLE HEATING LAMPS

CROSS-REFERENCE TO RELATED APPLICATION

This application claims priority from Korean Patent Application No. 10-2019-0151041 filed on Nov. 22, 2019 in the Korean Intellectual Property Office, and all the benefits accruing therefrom under 35 U.S.C. 119, the contents of which in its entirety are herein incorporated by reference.

BACKGROUND

Technical Field

The described technology relates to an electric heating apparatus, more specifically, to an electric heating apparatus with multiple heating lamps that may be installed for hatching and/or breeding livestock of poultry, cattle, swine, etc. or for heating a bathroom in a home or other areas that need to be heated.

Description of Related Technology

Infrared heating lamps typically emit thermal energy with a temperature of about 200 degrees Celsius to elevate the temperature of an area and have various applications, for example, in stables of livestock, for a portable bath sauna, and as an area heater for a bathroom.

Related art is described in Korean Patent Registration No. 10-1428785 (Heating cap of water proof for infrared lamp). In this related art, a socket is fixed to an upper side of a heating dish, and protrusions of a heat dissipation cap are adhered and fixed to the heating dish, and thus the heat of the heating lamp itself cannot be dissipated out of the heating dish, thereby possibly causing the heating lamp to be accidentally detached from the socket due to thermal expansion of the socket.

SUMMARY

An objective of the described technology is to provide an electric heating apparatus with multiple heating lamps that can increase the heat emitted by a single heating apparatus, thereby allowing a minimal number of heating apparatus installations in the space where heating is needed, and can emit the heat of the heating apparatus itself to the exterior as much as possible, thereby improving the durability and stability of the heating apparatus.

Another objective of the described technology is to provide an electric heating apparatus with multiple heating lamps that can prevent fires and electrocution by turning the power of the heating apparatus off in the event of the heating apparatus becoming detached and falling off from its support.

To achieve the objectives above, an electric heating apparatus with multiple heating lamps according to an embodiment of the described technology can be equipped with multiple heating lamps on the inside of the reflector dish to be capable of emitting high thermal energy from a single heating apparatus. The heating lamps can be installed on the inside of the reflector dish, each with an inclination, so that a broader range of irradiation may be provided.

A heat dissipation cap can be structured such that sockets which receive and connect to the heating lamps and a heat dissipation body on which heat dissipation fins are formed are formed as an integrated body, so that the heat generated in the heating lamps themselves can be efficiently discharged through the sockets to the heat dissipation fins. The reflector dish can have a hot-air vent formed in the upper surface to discharge the heat inside the reflector dish upwards, and the hot air discharged through the hot-air vent can be discharged to the exterior through a separated gap between the rim of the heat dissipation cap and the upper surface of the reflector dish.

Therefore, the transfer of heat from the heating lamps themselves positioned within the reflector dish can be achieved by conduction through the heat dissipation cap as well as by convection through the hot-air vent formed in the upper surface of the reflector dish.

The described technology can control all lamps or individual lamps in terms of turning the power on/off and dimming through remote control using near-field communication or manual control using a dial switch, touchpad, etc., so that the temperature and illuminance of the space where heating is needed may be controlled from the electric heating apparatus with multiple heating lamps.

With the described technology, if the heating apparatus were to fall off from the holder due to damage to the rope, chain, etc., the elastic force of a spring compressed by the weight of the heating apparatus can return the hanger can to its original position and at the same time operate the switch for supplying power to the heating lamps such that the lamps are turned off.

According to the described technology above, multiple heating lamps may be positioned within the reflector dish, and the heating lamps may have particular inclinations, allowing a broader range of irradiation, and increasing efficiency in terms of installing, maintaining, and operating the electric heating apparatus.

Also, instead of having the sockets affixed to the reflector dish, the structure has the sockets inserted in and secured to the socket connectors of the heat dissipation cap with heat dissipation fins formed on the lower surface touching the upper portion of the reflector dish, so that the heat of the reflector dish and the heating lamps themselves may be discharged by way of conduction, while at the same time, the hot air inside the reflector dish may be moved to the upper portion of the reflector dish through a hot-air vent and afterwards may be discharged to the exterior by way of convection through the rim side of the heat dissipation cap. Through such increased efficiency in heat dissipation, the durability and safety of the heating apparatus can be improved.

All of the heating lamps or individual heating lamps can be controlled with respect to turning the power on/off and dimming by using remote control and manual control. Thus, the described technology can improve user convenience by allowing the user to adjust the temperature and illuminance in the space where the electric heating apparatus is installed.

In the event of the electric heating apparatus becoming detached from the holder, the power supply can be cut off immediately, so that the risk of fires or electrocution can be fundamentally prevented.

DETAILED DESCRIPTION

In a typical heating apparatus, only one heating lamp is positioned within a heating dish, when supplying and maintaining the required temperature according to the space where heating is needed, a multiple number of heating devices must be installed, so that additional structures are needed for supporting the heating devices, and there are difficulties in maintaining the multiple heating devices individually. Moreover, if a heating device were to fall off from a holder, this would create a risk of a fire or electrocution.

The descriptions that follow are provided as examples only and merely illustrate certain embodiments of the described technology. The principles and concepts of the described technology are provided in consideration of both usefulness and ease of description.

Therefore, structures are not described in a level of detail that goes beyond what is necessary for a basic understanding of the described technology, and various embodiments are provided as examples in a manner that would allow those of ordinary skill in the art to practice the described technology.

The compositions and operations of certain preferred embodiments of the described technology are described below in more detail with reference to the accompanying drawings.

Figure 1:
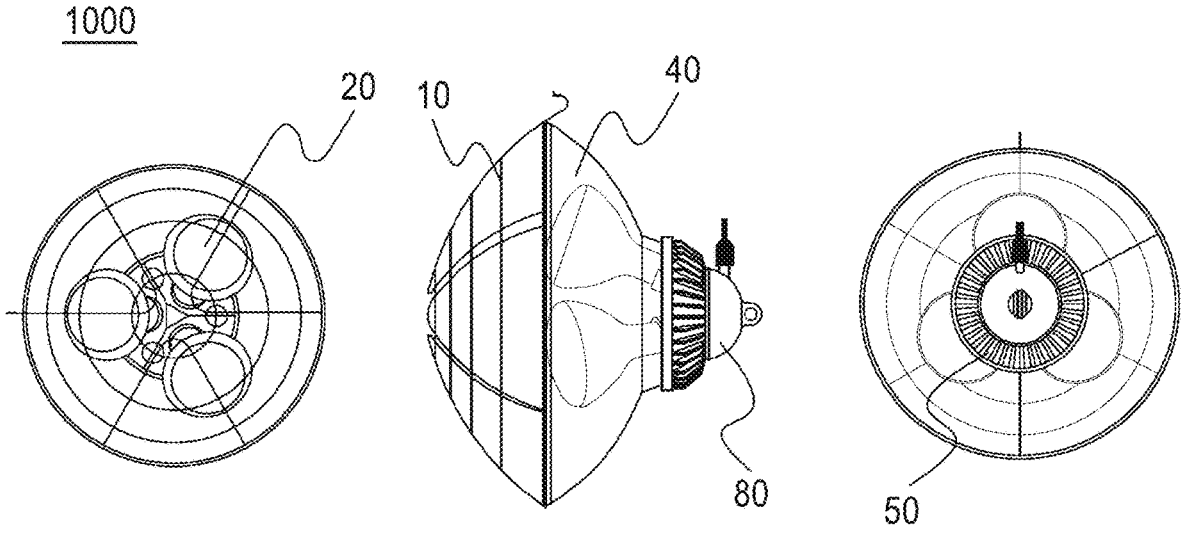
FIG. 1 illustrates the outer appearance of an electric heating apparatus with multiple heating lamps according to an embodiment of the described technology.
Figure 2:
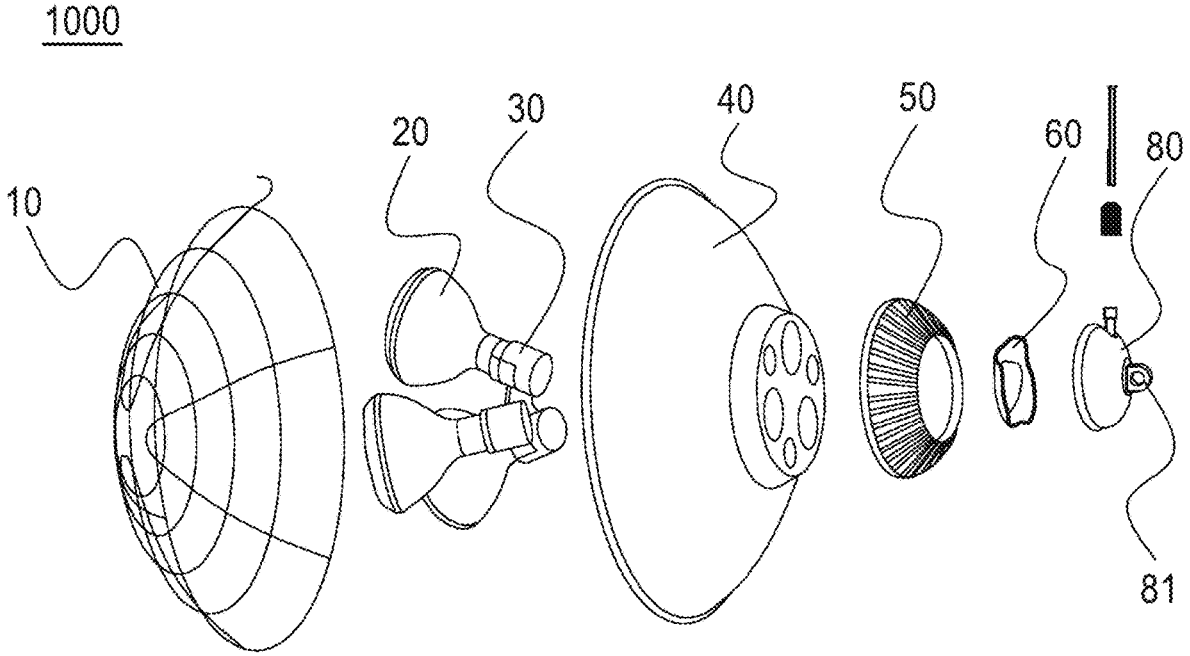
FIG. 2 is an exploded perspective view of an electric heating apparatus with multiple heating lamps according to an embodiment of the described technology.

FIG. 1 shows diagrams illustrating the outer appearance of an electric heating apparatus with multiple heating lamps according to an embodiment of the described technology, and FIG. 2 shows an exploded perspective view of an electric heating apparatus with multiple heating lamps according to an embodiment of the described technology.

As shown in FIGS. 1 and 2, an electric heating apparatus 1000 with multiple heating lamps can include a reflector dish 40, a multiple number of heating lamps 20 positioned on within the reflector dish, a heat dissipation cap 50 configured to discharge the heat generated from the heating lamps to the exterior, and a cover 80 that is connected with an upper portion of the heat dissipation cap and is configured to protect the wire for supplying electricity to the heating lamps.

The electric heating apparatus 1000 can have multiple heating lamps 20 installed on the inside of the reflector dish, so that when the electric heating apparatus is installed according to the required temperature in the space where heating is needed, the installation, maintenance, and operation can be made more efficient compared to case of the conventional heating apparatus having a single lamp. For example, if a space where heating is needed requires thirty heating lamps to provide the required temperature, using a heating apparatus having a single heating lamp would need thirty heating apparatuses and hence would require considerable work in installing mounts for the heating apparatuses, placing wiring for the electrical supply, and the like. However, an electric heating apparatus 1000 based on the described technology can have three heating lamps installed within a single reflector dish, so that in the example above, just ten heating apparatuses would be needed, and the installation work and wiring placement involved would be much simpler. Also, although it is not shown in the drawings, an electric heating apparatus 1000 based on the described technology can receive temperature measurements from a temperature sensor positioned at a particular location in the space where heating is needed to control the temperature in the space where heating is needed or can be controlled efficiently by a central management apparatus that can control the on/off state of the heating lamps.

The heating lamps 20 can include various heating lamps, such as infrared heating lamps, etc., that are capable of providing a particular temperature in a space for hatching and breeding livestock or any other space where heating is needed, such as a sauna, bathroom, etc. The multiple heating lamps 20 can be installed each with a particular inclination within the reflector dish so as to irradiate a broad range.

The electric heating apparatus 1000 can further include a protective screen 10, which may be installed at a lower portion of the reflector dish, to protect the heating lamps 20 positioned inside the reflector dish 40 and to prevent burns in the event of contact with a person's body.

The electric heating apparatus 1000 can have a wire guide 60, for distributing the electrical wires to the respective sockets 30 in an organized manner, positioned between the heat dissipation cap 50 and the cover 80. The wire guide 60 can have a screw fastener formed on the lower surface to be screw-joined with a wire guide-fastening hole 58 of the heat dissipation cap 50, so that the wire guide 60 may be coupled to an upper portion of the heat dissipation cap 50. The heating lamps 20 can be connected to the heat dissipation cap 50 by sockets 30. The sockets 30 can be inserted into socket connectors 59 formed in the heat dissipation cap 50 to be coupled to the heat dissipation cap 50. A hanger piece 81 can be formed on the upper end of the cover 80 for use in installing the electric heating apparatus.

Figure 3:
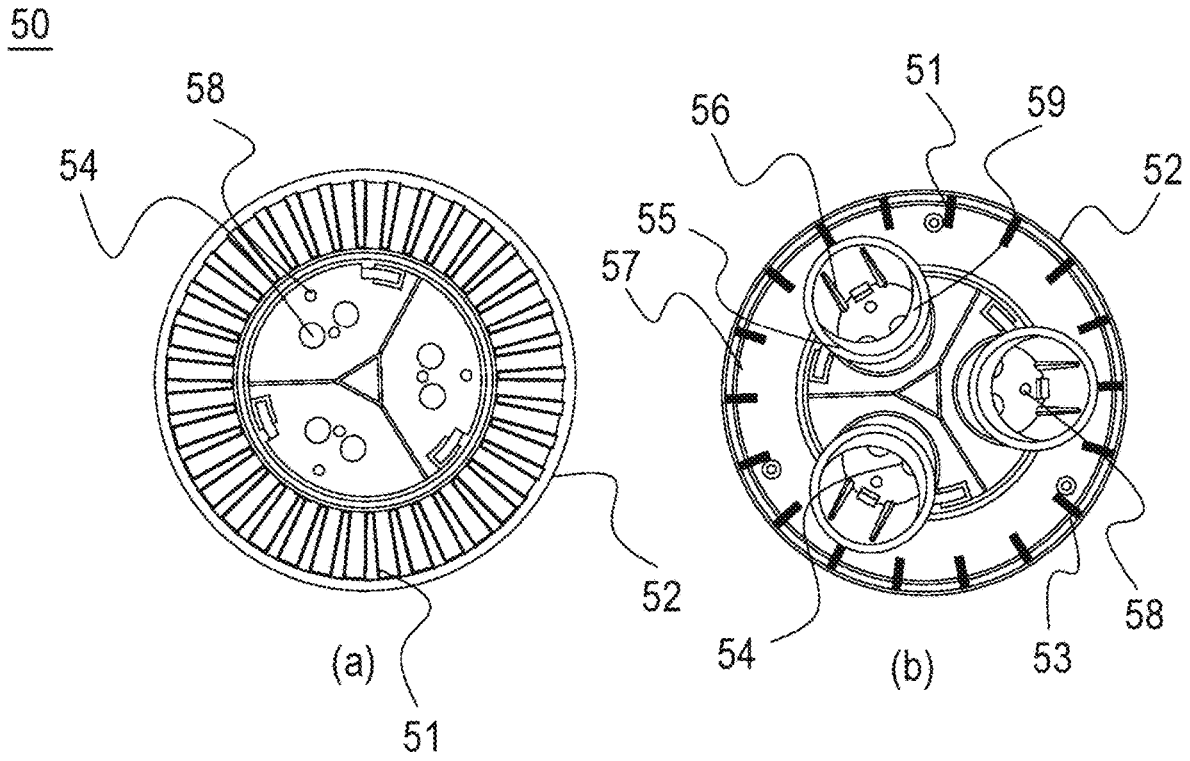
FIG. 3 illustrates the heat dissipation cap of an electric heating apparatus with multiple heating lamps according to an embodiment of the described technology.
Figure 5:
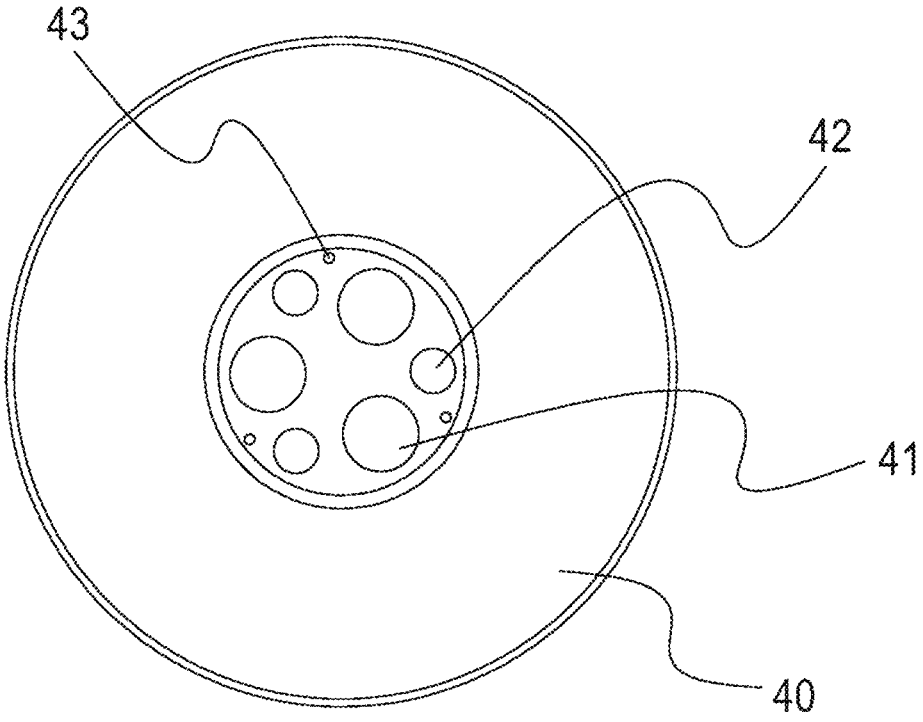
FIG. 5 illustrates the structure of a reflector dish according to an embodiment of the described technology.

FIG. 3 illustrates the heat dissipation cap of an electric heating apparatus with multiple heating lamps according to an embodiment of the described technology, and FIG. 5 illustrates the structure of a reflector dish according to an embodiment of the described technology.

Referring to FIG. 3, the heat dissipation cap 50 can include a heat dissipation body 57, a multiple number of heat dissipation fins 51 formed extending vertically from the upper surface (drawing (a)) and lower surface (drawing (b)) of the heat dissipation body 57, and at least one or more socket connectors 59 to which sockets having the heating lamps coupled thereto may be inserted. Drawing (a) of FIG. 3 illustrates the upper surface of the heat dissipation cap 50, and drawing (b) of FIG. 3 illustrates the lower surface of the heat dissipation cap 50. As shown in drawing (b) of FIG. 3, the lower surface of the heat dissipation cap 50 can be formed concavely, similarly to the inner surface of a conical hat, and can have socket connectors 59 formed into which the sockets 30 may be inserted. When the heat dissipation cap 50 is connected to the upper surface of the reflector dish, the concave space beneath the heat dissipation cap can be used as space through which the hot air discharged from the reflector dish hot-air vent may move.

The heat dissipation cap 50 can be coupled to the reflector dish 40 as each socket connector 59 formed on the heat dissipation cap 50 is inserted through a socket connection hole 41 formed in the upper surface of the reflector dish 40 and, while in this state, is fastened by a screw joint to a screw-fastening hole 43 of the reflector dish and a reflector-fastening hole of the heat dissipation cap. In this case, a reflector-connection guide 55 formed on the outer surface of the socket connector 59 can touch the upper surface of the reflector dish such that the heat dissipation cap 50 is supported and secured to the upper portion of the reflector dish. In a bottom surface of the socket connector 59, a wire passage hole 54 can be formed through which an electrical wire introduced from the wire guide may pass.

The bottom surface of each socket connector 59 can be formed with an inclined slope of a particular angle from the center of the heat dissipation cap 50 such that the multiple heating lamps 20 may each have an inclination within the reflector dish. The multiple heating lamps 20 connected by the sockets 30 to the socket connectors 59 formed with inclinations can irradiate heat to below the reflector dish while each is inclined at a particular angle. Thus, the inclined heating lamps 20 can emit thermal energy over a broad space to maximize the transfer of heat. A multiple number of socket-connection guides 56 can be formed on the inner surface of each socket connector 59 in a direction corresponding to the length of the socket. The socket-connection guides 56 can be press-fitted onto the outer surface of the socket 30. The socket-connection guides 56 can be used as paths of heat transfer for transferring the heat generated in the heating lamp 20 itself through the socket 30 to the heat dissipation cap 50.

Figure 4:
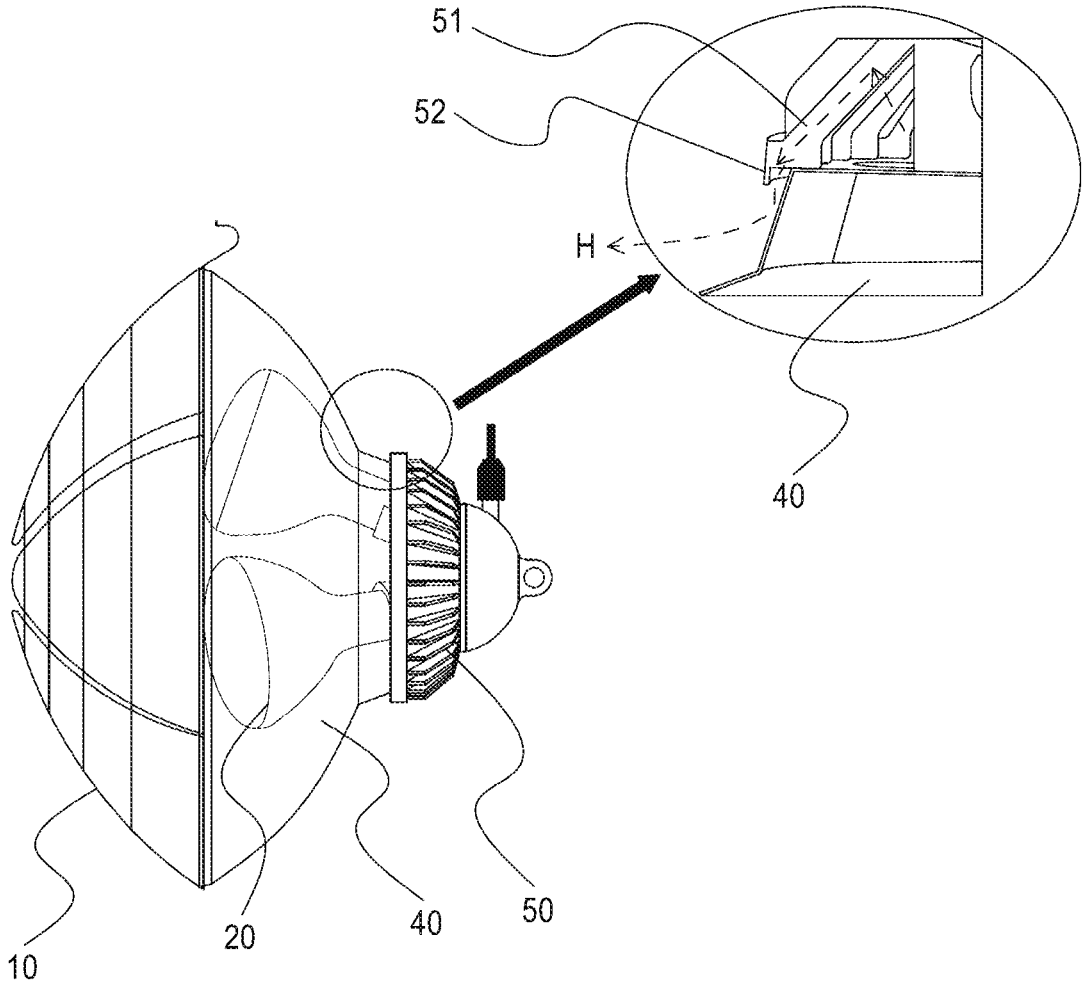
FIG. 4 illustrates the connection structure between the heat dissipation cap and the reflector dish for discharging the heat inside of the reflector dish to the exterior by convection according to an embodiment of the described technology.

FIG. 4 illustrates the connection structure between the heat dissipation cap and the reflector dish for discharging the heat inside the reflector dish to the exterior by convection according to an embodiment of the described technology.

Referring to FIG. 4, the distal ends of the heat dissipation fins 51 formed extending vertically on the lower surface of the heat dissipation body 57 can be placed in contact with the upper surface of the reflector dish 40 to discharge the heat of the reflector dish itself by thermal conduction to the exterior through the heat dissipation cap 50. When the heat dissipation cap is connected to the upper surface of the reflector dish, the rim 52 of the heat dissipation cap, i.e. the edge of the heat dissipation body 57, can be positioned with a particular gap from the upper surface of the reflector dish. The heat within the reflector dish 40 can be discharged through a multiple number of hot-air vents 42 formed in the upper surface of the reflector dish to the concave space between the heat dissipation cap 50 and the reflector dish 40. Afterwards, the heat discharged into this concave space can be discharged to the exterior of the electric heating apparatus through a gap H separated between the rim 52 of the heat dissipation cap and the upper surface edge of the reflector dish 40. When the heat dissipation cap is connected to the upper surface of the reflector dish, the end portion of the rim 52 of the heat dissipation cap can be positioned lower than the uppermost surface of the reflector dish. Thus, even if the electric heating apparatus is installed in a space where it is possible for water to infiltrate the interior of the electric heating apparatus, since the end portion of the rim of the heat dissipation cap is positioned lower than the uppermost surface of the heating dish, water is prevented from infiltrating the interior of the electric heating apparatus through the gap H for discharging the heat inside the heating dish.

Thus, the electric heating apparatus 1000 can discharge the heat of the reflector dish and the heating lamps themselves by way of the heat dissipation cap, by discharging the heat through the heat dissipation fins 51 touching the reflector dish and the reflector-connection guides 55 of the socket connectors, while at the same time having the hot air within the reflector dish moved to an upper portion of the reflector dish through the hot-air vents 42 and afterwards moved along the heat dissipation fins and discharged to the exterior through the separated gap H formed at the edge of the heat dissipation cap, to thereby provide improved durability and safety.

Figure 6:
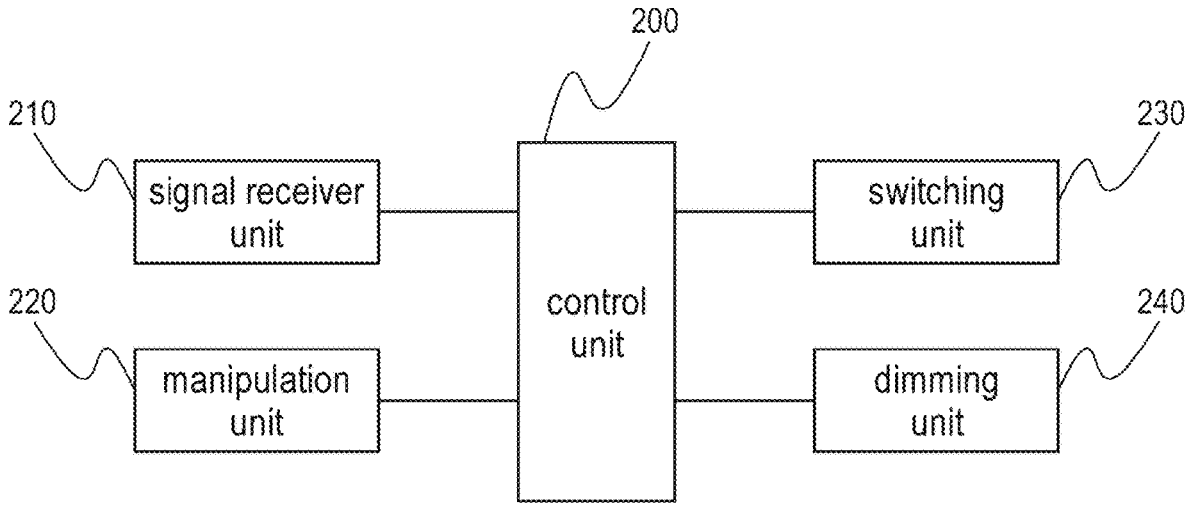
FIG. 6 is a block diagram for describing the control operation of a heating lamp according to an embodiment of the described technology.

FIG. 6 is a block diagram for describing the control operation of a heating lamp according to an embodiment of the described technology.

As shown in FIG. 6, the electric heating apparatus 1000 can include a control unit 200 capable of controlling the multiple heating lamps in terms of turning the power on/off and dimming. The control unit can be a microcontroller (MCU) operated by a particular program that can control the typical operations of an electric heating apparatus and can be positioned inside the cover 80. The electric heating apparatus 1000 can include a signal receiver unit (or a signal receiver) 210 that receives a command execution signal for the heating lamps outputted from a remote control, a control unit (or a controller) 200 that outputs a control command according to the command execution signal received from the signal receiver unit, a switching unit (or a switch) 230 that controls the power reception state according to the control command of the control unit to turn individual heating lamps or all heating lamps on or off, and a dimming unit (or a dimming circuit) 240 that controls the illuminance of individual heating lamps or all heating lamps according to the control command of the control unit.

A manipulation unit (or a manipulation circuit) 220 can be installed within an expansion panel extending from the cover 80 and can include any of a variety of input devices, such as a dial switch, touchpad, etc., capable of providing a dimming command execution signal for turning on/off and dimming individual heating lamps or all heating lamps to the control unit.

The signal receiver unit 210 can use near-field communication technology such as Bluetooth, RFID (radio frequency identification), IrDA (infrared data association), UWB (ultra-wideband), ZigBee, etc.

When an on/off command execution signal inputted from the signal receiver unit 210 using near-field communication or a dimming command execution signal inputted from a manipulation unit 220 composed of a dial switch, touchpad, etc., is received, the control unit 200 can output a control command corresponding to the command execution signal to the switching unit 230 or the dimming unit 240 to control individual heating lamps or all of the heating lamps in terms of turning the power on/off or dimming.

Figure 7:
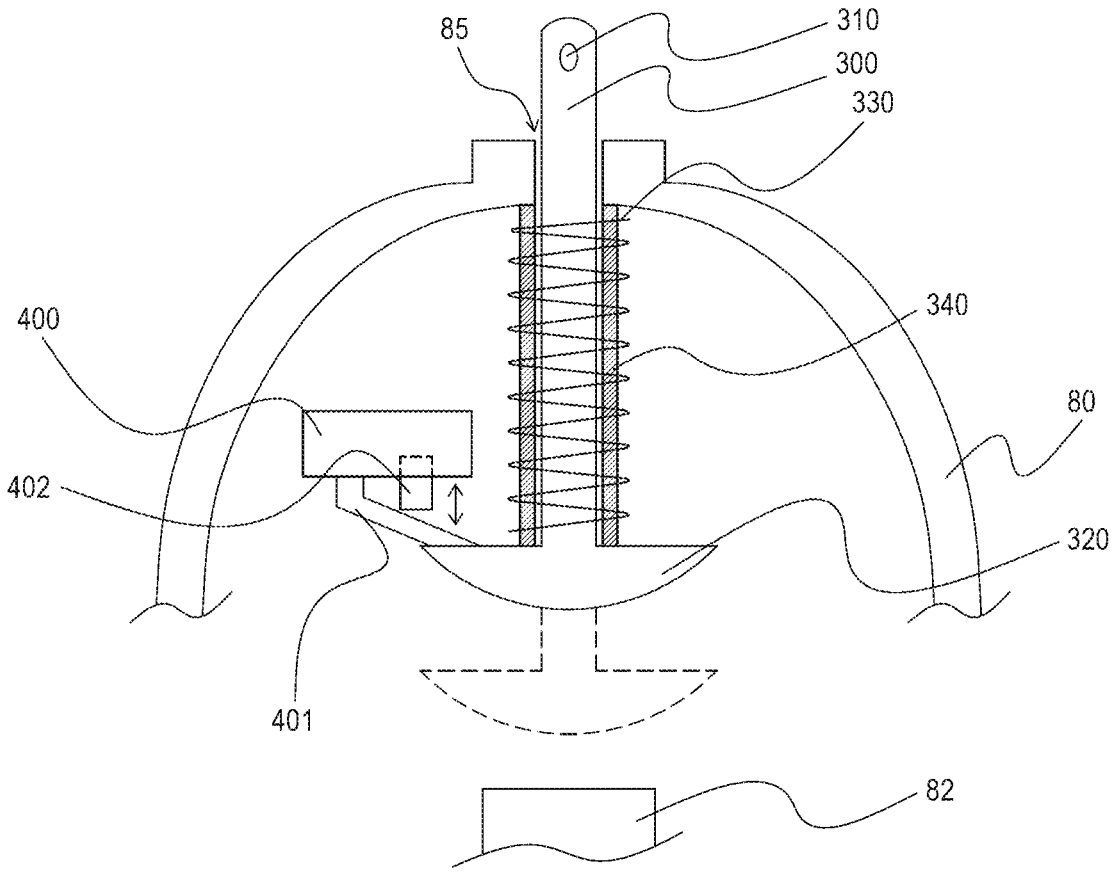
FIG. 7 is a cross-sectional view illustrating a structure for turning off power when an electric heating apparatus according to an embodiment of the described technology becomes detached and falls off from the holder.

FIG. 7 is a cross-sectional view illustrating a structure for turning off power when an electric heating apparatus according to an embodiment of the described technology becomes detached and falls off from the holder.

As shown in FIG. 7, the electric heating apparatus 1000 can include a hanger 300 that is inserted through a center aperture 85 of the cover 80 and has a support 320 formed at a lower portion thereof, a stopper 340 that extends downward from the upper inner surface of the cover 80 and has a distal end thereof placed in contact with an upper portion of the support 320, a spring 330 that is positioned between the upper inner surface of the cover and the support, and a switch 400 that is placed in contact with a surface of the support and is configured to turn power on/off according to the up/down movement of the support.

The electric heating apparatus 1000 can be suspended from a particular holder with a rope, chain, etc., fastened to a holding hole 310 formed in the hanger 300. When the electric heating apparatus 1000 is suspended and held from a holder, the hanger 300 may be moved upward due to the self weight of the electric heating apparatus 1000. As the hanger 300 is moved upward, the spring 330 may be compressed until the upper surface of the support 320 is placed in contact with the stopper 340. At the same time, a guide bar 401 and a button 402 of the switch 400 touching a surface of the support 320 may be pressed, and the switch 400 may be operated to allow a lighting of the heating lamps.

If the rope, chain, etc., fastened to the holding hole 310 were to become untied or snap by an external force, etc., the electric heating apparatus 1000 can fall downward. In such a case, as soon as the support 320 of the hanger 300 becomes detached from the stopper 340 due to the elastic force of the spring 330, the force pressing the guide bar 401 is removed, and the button 402 may pop out, operating the switch 400 and turning off the heating lamps. The switch can be composed of a magnetic switch, etc., that receives a force from an up/down movement of the hanger 300 to turn the switch on/off. Although a magnetic switch is described as an example, the switch 400 is not thus limited and can include any of a variety of switches such as a limit switch, a press switch, etc., having a structure capable of opening and closing the switch according to an up/down movement of the hanger 300.

Inside the cover, a protrusion 82 can be formed for restricting the distance of downward movement of the hanger 300 by the elastic force.

If an electric heating apparatus having a high temperature were to be detached from the holder and fall onto flammable material such as dry straw, etc., while the lamps have not been turned off, there is a high risk of a fire, which may cause great material losses and pose an important problem in safety. To prevent a fire from occurring because of such electric heating apparatus, the electric heating apparatus can be made to detect an inclination caused by a detachment and turn off the lamps. Although a mechanical switch such as a tilt switch, etc., is used as a structure for detecting an inclination in the electric heating apparatus, if the electric heating apparatus becomes detached from the holder but is placed on dry straw horizontally without being inclined, the electric heating apparatus would not be turned off and a fire could not be prevented. In preparation for such an occurrence, the described technology can have the switch turned off as the hanger is moved downward by the elastic force of the spring, just from the electric heating apparatus becoming detached from the holder, to immediately turn off the lamps and fundamentally prevent the risk of fire.

While the foregoing provides a detailed description of the described technology by way of representative embodiments, those having ordinary skill in the field of art to which the described technology pertains would understand that numerous variations can be derived from the embodiments described above without departing from the scope of the described technology.

Therefore, the scope of protection of the described technology is not to be limited to the embodiments described above but rather is to be defined by the claims set forth below as well as their equivalents.

What is claimed is:

1. An electric heating apparatus with one or more heating lamps, the electric heating apparatus comprising:

a reflector dish;

one or more heating lamps positioned at an inner portion of the reflector dish and configured to generate heat;

a heat dissipation cap coupled to an upper portion of the reflector dish and configured to dissipate the heat of the reflector dish and the one or more heating lamps to an exterior of the apparatus; and a cover coupled to an upper portion of the heat dissipation cap and configured to protect an electrical wire for supplying electricity to the one or more heating lamps, wherein the reflector dish comprises an outer upper surface and further comprises a socket connection hole and a hot-air vent formed in the outer upper surface, wherein the heat dissipation cap comprises a lower surface concavely formed and disposed to face the outer upper surface of the reflector dish to form a space between the outer upper surface and the lower surface, wherein the heat dissipation cap further comprises a plurality of heat dissipation fins formed on the lower surface and comprising distal ends placed on the outer upper surface of the reflector dish, and a rim formed along an edge of the lower surface, wherein the heat dissipation cap further comprises one or more socket connectors, each of which is formed with an inclined slope of a particular angle and inserted through the socket connection hole, wherein each of the one or more heating lamps is inserted into one of the one or more socket connectors by way of a socket to be given an inclined irradiation range, wherein the heat dissipation cap comprises a plurality of socket-connection guides formed on an inner surface of each socket connector in a direction corresponding to the length of the socket, wherein the socket-connection guides are configured to be press-fitted onto an outer surface of the socket, and wherein the heat dissipation cap and the reflector dish are coupled to form a heat discharge structure in which heat in a space surrounded by the reflector dish is discharged through the hot-air vent to the space formed between the outer upper surface of the reflector dish and the lower surface of the heat dissipation cap, and the heat is moved along with the heat dissipation fins and discharged to the exterior through a separated gap formed between the rim of the heat dissipation cap and an upper surface edge of the reflector dish.

2. The electric heating apparatus of claim 1, wherein the heat dissipation cap is coupled with the reflector dish by the one or more socket connectors, each of which is fastened by a screw joint to a screw-fastening hole of the reflector dish and a reflector-fastening hole of the heat dissipation cap while inserted through the socket connection hole.

3. The electric heating apparatus of claim 1, further comprising:

a signal receiver configured to receive a command execution signal for a heating lamp by way of near-field communication;

a controller configured to output a control command according to the command execution signal received from the signal receiver;

a switch configured to control a power reception state according to the control command to turn on or off one of the heating lamps or all of the heating lamps; and a dimming circuit configured to control an illuminance of one of the heating lamps or all of the heating lamps according to the control command.

4. The electric heating apparatus of claim 3, further comprising a manipulation circuit configured to provide a command execution signal for controlling an on/off state and a dimming state of one of the heating lamps or all of the heating lamps to the controller.

5. The electric heating apparatus of claim 1, wherein the rim extends downward towards the reflector dish, and wherein a lower end of the rim is positioned lower than the outer upper surface of the reflector dish.

* * * * *